United States Patent [19]

Knight

[11] 4,440,298

[45] Apr. 3, 1984

[54] GREETING CARDS

[75] Inventor: Peter E. Knight, Essex, England

[73] Assignee: Adrian Marsh Limited, Essex, England

[21] Appl. No.: 399,965

[22] Filed: Jul. 19, 1982

[30] Foreign Application Priority Data

Jul. 22, 1981 [GB] United Kingdom ..... 8122613

[51] Int. Cl.[3] ..... B65H 71/00

[52] U.S. Cl. ..... 206/216; 206/45.31; 206/232; 206/457; 206/458

[58] Field of Search ..... 206/216, 232, 458, 457, 206/494, 45.31; 229/87 A, 87 S, 87.5

[56] References Cited

U.S. PATENT DOCUMENTS

| | | | |
|---|---|---|---|
| 1,143,729 | 6/1915 | Schmidt | 206/216 X |
| 1,206,256 | 11/1916 | Roy | 229/87.5 |
| 1,244,522 | 10/1917 | McClay | 229/87.5 |
| 1,667,482 | 4/1928 | Lee | 229/87 A |
| 1,673,144 | 6/1928 | George | 229/8 |
| 1,780,136 | 10/1930 | Lee | 229/87 A |
| 1,907,937 | 5/1933 | Lerkoff | 206/458 |
| 1,922,213 | 8/1933 | Middleton | 206/232 |
| 2,241,673 | 5/1941 | Mogabgab | 206/232 |
| 3,762,630 | 10/1973 | Braznell | 206/232 |

*Primary Examiner*—William T. Dixson, Jr.
*Assistant Examiner*—Brenda J. Ehrhardt
*Attorney, Agent, or Firm*—Watson, Cole, Grindle & Watson

[57] ABSTRACT

A greeting card is adapted to serve as a gift wrapping for a garment, especially a T-shirt, and has a pocket to receive the garment formed by a sheet of transparent material attached to the inside of the rear cover, the front cover having a window through which the garment is visible.

2 Claims, 4 Drawing Figures

GREETING CARDS

This invention is concerned with greeting cards. More particularly, the invention relates to a greeting card adapted to serve as a gift wrapping or package.

It has been proposed to provide greeting card blanks which enable customers to mount a personally selected picture, either in the form of a postcard or photographic print as disclosed in G.B. Patent Specification No. 1393199, or photographic transparencies as described in G.B. Patent Specification No. 927561. The purpose of these prior art blanks is to allow each person to choose the picture carried by the card thereby adding a personal contribution to the design as a whole.

The present invention is based on an entirely novel idea in the field of greeting cards and involves a significant departure from the conventional forms of greeting card belonging to the prior art.

According to the invention there is provided a greeting card comprising front and rear covers hinged together to enable the card to be opened and closed characterized in that the rear cover comprises a pocket receiving a garment which is folded substantially flat, whereby the card serves additionally as a gift wrapping for the garment.

The invention embodies a new concept in gift wrapping. Greeting cards are generally sent on occasions when it is also usual for gifts to be given. Hitherto it has been the practice to wrap the gift separately. The present invention in an especially neat and simple way combines greeting card with gift in a single item, the card serving as a wrapping for the gift which takes the form of a garment.

In a preferred embodiment the front cover has a window and at least a portion of the garment, in particular a T-shirt, received in the pocket of the rear cover is visible through the window when the card is closed. The pocket may be defined between the rear cover and a transparent sheet attached to the inside of the cover.

It is common for T-shirts to be printed with slogans, motifs and logos or to have decorative patches or badges applied to them, and in accordance with a particularly novel feature of the invention, whatever has been applied to the garment, preferably in such a way as to be seen through the front cover window when the garment is placed in the pocket, is also reproduced on the inside of the rear cover so as to be visible through the window when the garment has been removed.

To enable a better understanding of the invention reference will now be made to the drawings illustrating the preferred embodiment of the invention and in which.

Figure 1:
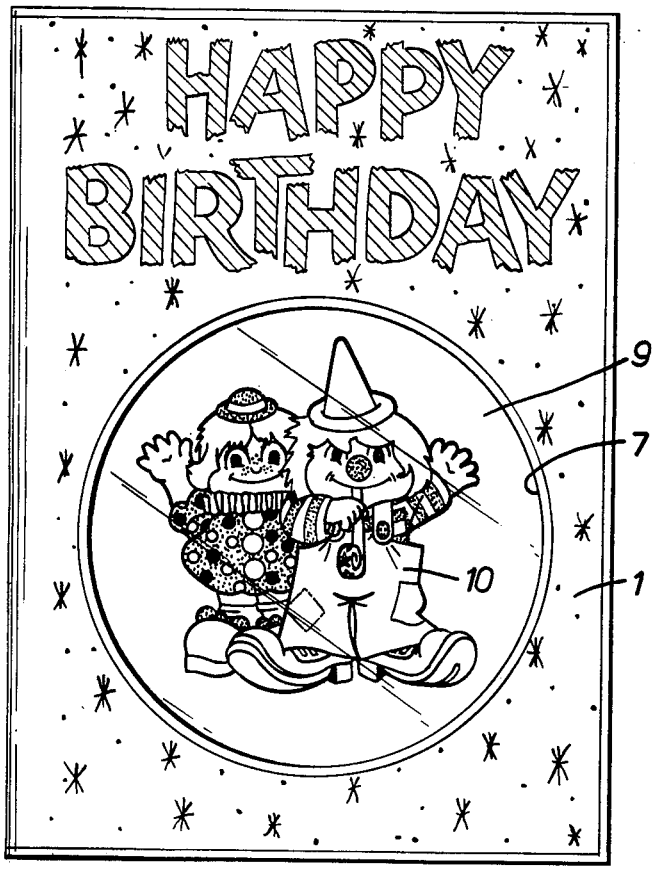
FIG. 1 is a front elevation of the greeting card shown as a birthday card.
Figure 2:
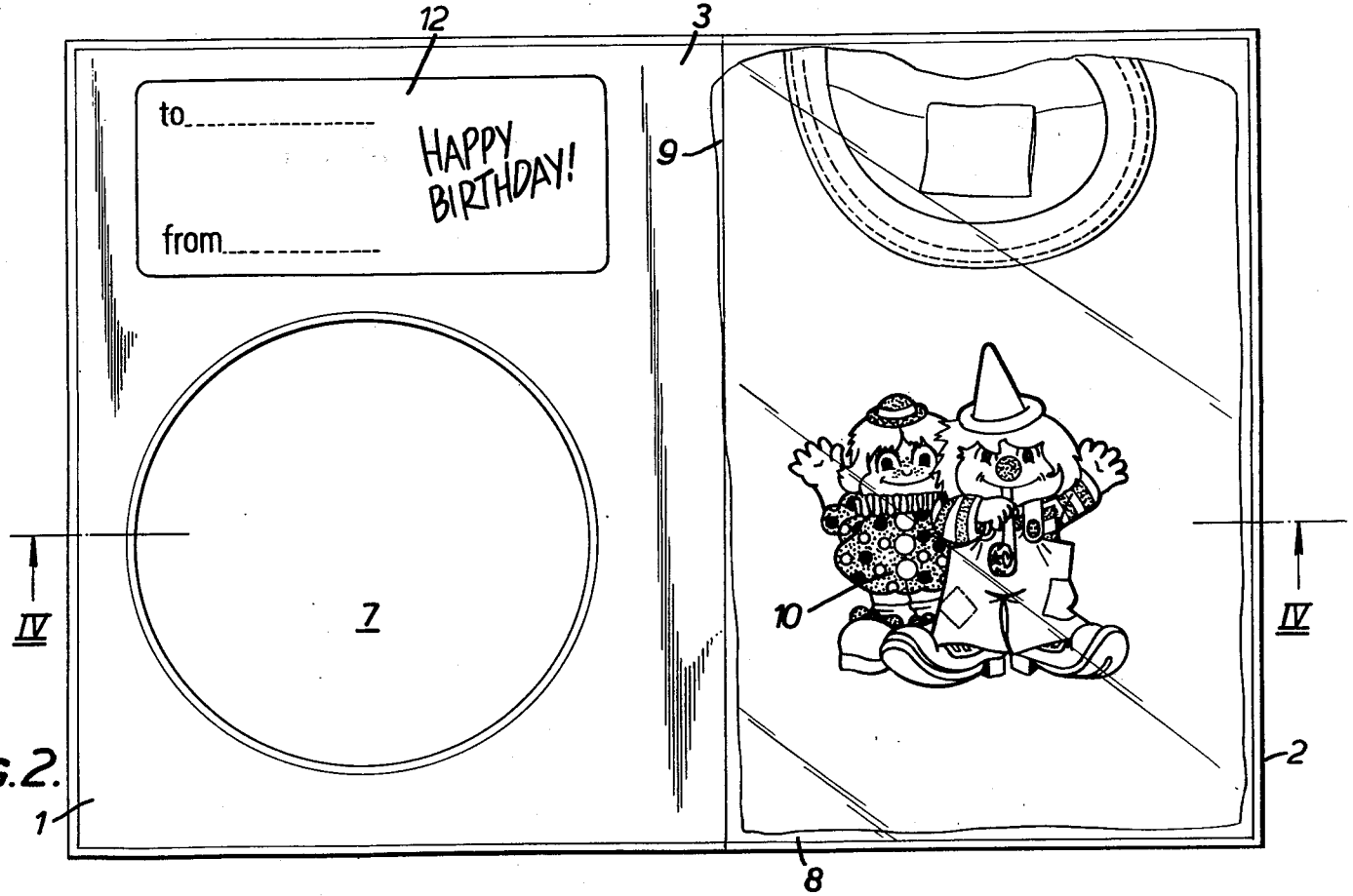
FIG. 2 is a plan view of the card opened up.

The illustrated greeting card includes a front cover 1 and a rear cover 2 connected by an integral hinge portion 3. The front and rear covers are formed by welding together around their peripheries two sheets 4,5 of thermo-plastic material, each cover being reinforced by stiff card 6, the hinge portion 3 being left unstiffened so that the two sheets 4,5 define in this region a freely flexible hinge.

The front cover is provided with a window which in the illustrated embodiment takes the form of a circular aperture 7. The sheets 4,5 are also welded together around the aperture periphery.

Figure 3:
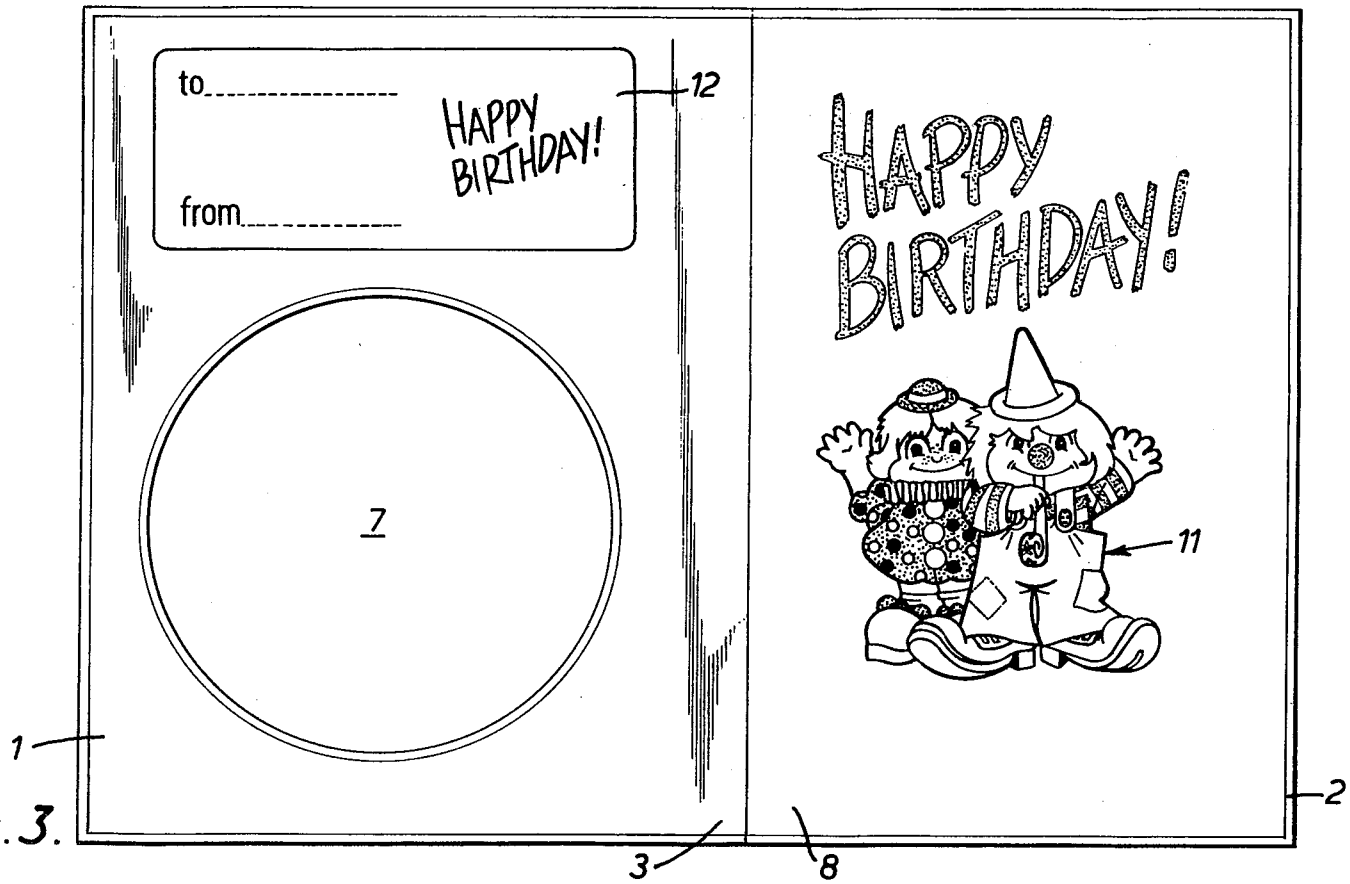
FIG. 3 is a view similar to FIG. 2 but with the T-shirt removed.
Figure 4:
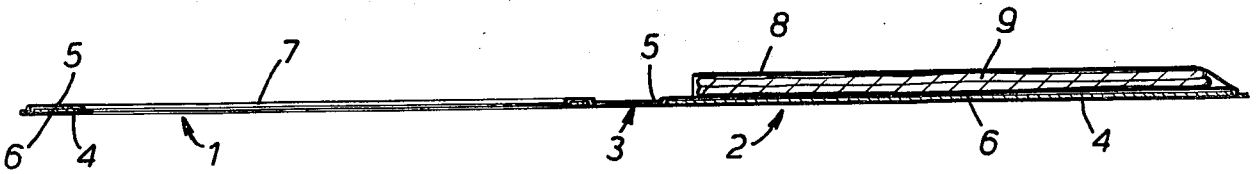
FIG. 4 is a cross-section taken along the line IV—IV in FIG. 2.

To the inside of the rear cover 2 is fixed a sheet 8 of clear plastics material. The sheet 8 may be attached to the cover by welding or bonding along the top, bottom and free side edge of the cover, and defines with the cover 2 an open-sided pocket or envelope in which a garment having the form of a T-shirt 9 is received. The T-shirt shown in the drawings carries a badge 10 depicting a pair of clowns and when correctly folded and placed in the pocket this badge is seen through the window aperture 7 in the front cover of the card, as is clear from FIG. 1. Furthermore, the picture depicted by the badge is reproduced in printed form, as indicated at 11 in FIG. 3, on the inside of the rear cover so that the same picture is seen through the window aperture 7 when the T-shirt has been removed from the pocket.

The front and rear covers may be printed with appropriate messages according to the type of greeting card desired and as shown an adhesive label 12 is applied to the inside of the front cover to enable a personal message to be added by the purchaser.

From the foregoing it will be appreciated that a greeting card according to the invention provides an attractive and novel form of wrapping for a present in the form of a garment. Many modifications are of course possible without departing from the invention. For example the card could be made from stiff card rather than plastics; the window may be provided by see-through plastics sheet material rather than an aperture; a separate envelope holding the garment may be attached to the rear cover so as to be detachable; and the pocket could be opaque except for a window aperture or clear plastics portion in register with the portion of the garment to be visible through the front cover window. Other variations are possible and will occur to skilled readers.

What is claimed is:

1. A greeting card comprising a front cover, a rear cover connected to the front cover by a hinge to enable the card to be opened and closed, a sheet of clear material attached to the inside surface of the cover and sealed thereto along the free edges of said rear cover, said sheet defining with the rear cover a pocket, a garment folded substantially flat and received in said pocket, and a window in the front cover, said garment being visible through said window when the card is closed.

2. A greeting card according to claim 1 wherein the garment is a T-shirt carrying a decorative slogan, emblem or the like which is visible through said window, and a corresponding decoration is applied to the rear cover to be visible through the window when the T-shirt has been removed from the pocket.

* * * * *